US008540070B2

(12) United States Patent
Holloway P.E.

(10) Patent No.: US 8,540,070 B2
(45) Date of Patent: Sep. 24, 2013

(54) COIL SHIFT TRANSFER CAR

(75) Inventor: Ward Holloway P.E., Barre, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 253 days.

(21) Appl. No.: 13/185,902

(22) Filed: Jul. 19, 2011

(65) Prior Publication Data

US 2013/0020179 A1 Jan. 24, 2013

(51) Int. Cl.
*B65G 37/00* (2006.01)

(52) U.S. Cl.
USPC ..... 198/574; 198/463.3; 414/281

(58) Field of Classification Search
USPC ..... 198/312, 409, 463.3, 574, 586; 414/281, 414/282
See application file for complete search history.

(56) References Cited

U.S. PATENT DOCUMENTS

| | | | | |
|---|---|---|---|---|
| 4,236,626 | A * | 12/1980 | Noe | 198/468.6 |
| 4,349,097 | A * | 9/1982 | Curti | 198/369.5 |
| 4,971,508 | A * | 11/1990 | JPX et al. | 414/282 |
| 5,274,984 | A * | 1/1994 | Fukuda | 53/451 |
| 5,332,351 | A * | 7/1994 | Nelson et al. | 414/684 |
| 5,636,727 | A * | 6/1997 | Neri et al. | 198/574 |
| 6,149,366 | A * | 11/2000 | Deandrea | 414/279 |
| 6,722,836 | B2 * | 4/2004 | Jager | 414/222.01 |
| 7,334,314 | B2 * | 2/2008 | Nussbaum et al. | 29/564 |
| 7,546,971 | B2 * | 6/2009 | Pappas | 242/533.7 |
| 7,699,158 | B2 * | 4/2010 | Aust et al. | 198/435 |
| 7,806,643 | B2 * | 10/2010 | Friedman et al. | 414/222.01 |
| 7,887,278 | B2 * | 2/2011 | Hoshino | 414/217.1 |
| 7,909,158 | B2 * | 3/2011 | Noe et al. | 198/463.3 |
| 7,950,516 | B2 * | 5/2011 | De Leo et al. | 198/347.4 |
| 8,340,851 | B2 * | 12/2012 | Wang | 701/23 |
| 8,348,588 | B2 * | 1/2013 | Yoshida et al. | 414/561 |
| 8,408,381 | B2 * | 4/2013 | Murakami et al. | 198/468.8 |

FOREIGN PATENT DOCUMENTS

| | | | |
|---|---|---|---|
| JP | 50034500 | B | 11/1975 |
| JP | 11033624 | A | 2/1999 |
| JP | 2000343121 | A | 12/2000 |

OTHER PUBLICATIONS

PCT International Search Report mailed Oct. 25, 2012 corresponding to PCT International Application No. PCT/US2012/043232 filed Jun. 20, 2012 (11 pages).

* cited by examiner

*Primary Examiner* — Douglas Hess

(57) ABSTRACT

A system is disclosed for transferring a cylindrical coil suspended on a first stem projecting horizontally from a first base to a remotely positioned and axially aligned second stem projecting horizontally from a second base. The system comprises a track extending between the first and second stems, a carriage movable along the track, and a conveyor on the carriage, with a receiving end and a delivery end. The carriage is movable along the track to a first location at which the receiving end of the conveyor underlies the coil suspended from the first stem. The conveyor is vertically adjustable from a lowered position spaced beneath the coil to an elevated position at which the coil is lifted from the first stem and supported on the receiving end of said conveyor, with the conveyor then being operable to shift the coil to a position supported on the conveyor delivery end. The carriage is then shiftable to a second location at which the coil is axially inserted on the horizontally positioned second stem, with an end of the coil in contact with the second base. The conveyor is then lowered to deposit the coil on the second stem, thereby allowing the carriage to again move along the track to begin another coil transferring cycle.

8 Claims, 14 Drawing Sheets

COIL SHIFT TRANSFER CAR

BACKGROUND

1. Field

Embodiments of the present invention relate generally to systems for handling vertical coils of hot rolled products produced by a rolling mill, and more particularly to a system for transferring the coils between axially aligned horizontally disposed stems.

2. Description of Related Art

In modern day rolling mills producing hot rolled bars or rods, the finished products are formed into rings which are deposited on vertical stems where they accumulate into cylindrical coils weighing 1000 kg or more. The front and tail end product segments are typically off gauge and/or metallurgically deficient, and must be trimmed and removed from the tops and bottoms of the coils before the coils are compacted, tied, and readied for shipment.

Front and tail end trimming is typically performed manually by mill personnel in the course of transferring the coils between axially aligned horizontally disposed stems. In the past, this procedure has proven to be overly time consuming, with the coil interiors being prone to scratching as a result of sliding contact with the stems.

SUMMARY

A system of the present invention is designed to transfer a coil suspended on a first stem projecting horizontally from a first base to a remotely positioned and axially aligned second stem projecting horizontally from a second base. When suspended on the first stem, the coil has an exposed top end and a bottom end in contact with the first base. Mill personnel may thus remove and trim product rings from the top end of the coil before the coil is shifted to the second stem.

In one exemplary embodiment, this shifting can be performed by a system comprising a track extending between the first and second stems. A carriage is movable along the track, and a conveyor having a receiving end and delivery end is mounted on the carriage.

A first operating means moves the carriage along the track to a first location at which the receiving end of the conveyor underlies and is spaced beneath the coil suspended on the first stem.

A second operating means raises the conveyor to an elevated position at which the coil is lifted from the first stem and supported on the receiving end of the conveyor. The conveyor is then operable to shift the coil to the delivery end of the conveyor. The first operating means then moves the carriage to a second location at which the coil is axially inserted on the second mandrel, with the previously trimmed top end of the coil in contact with or directly adjacent to the second base. The second operating means then serves to lower the conveyor, resulting in the coil being deposited on the second stem. The carriage is then moved along the track out from under the second stem, leaving the bottom of the coil exposed for trimming by mill personnel.

In a further exemplary embodiment, containment means are provided for axially confining the coil during its transfer from the first stem to the second stem. The containment means preferably comprises finger elements movable into and out of engagement with opposite ends of the coil. Preferably, the finger elements are mounted for movement with the coil as the coil is shifted from the receiving end to the delivery end of the conveyor.

In another exemplary embodiment, the first operating means comprises a rack extending along the track, with the track being engaged by a driven sprocket carried by the carriage.

In still another exemplary embodiment of the invention, the second operating means comprises an elevator platform vertically adjustable by linkage means on the carriage.

These and other embodiments, objects, features and advantages of the present invention will become more apparent upon reading the following specification in conjunction with the accompanying figures.

DETAILED DESCRIPTION

Figures 1, 1A:
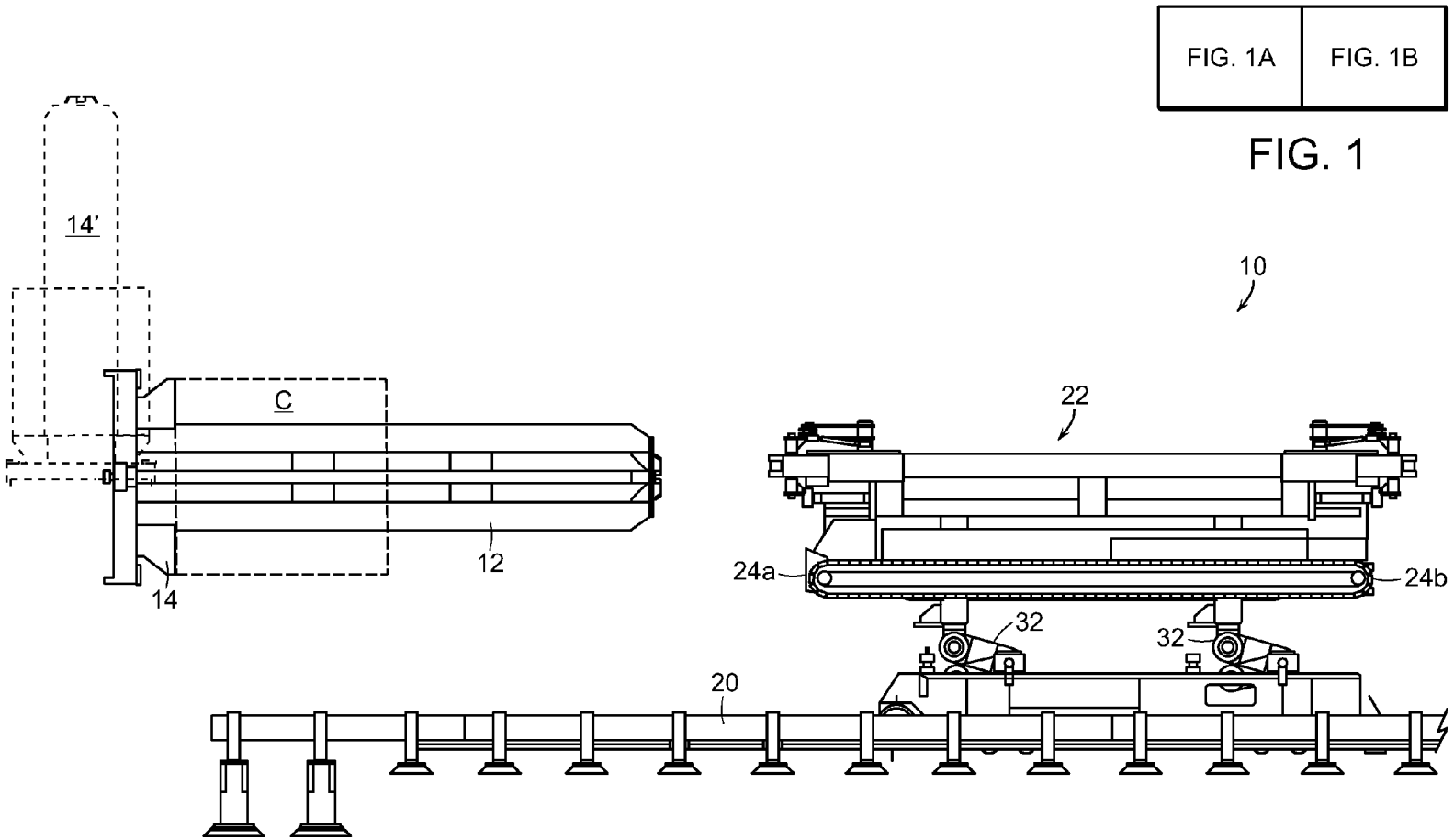
FIG. 1 is a side view of a system, in accordance with an exemplary embodiment of the present invention.

To facilitate an understanding of embodiments, principles, and features of the present invention, they are explained hereinafter with reference to implementation in illustrative embodiments.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Referring now to the figures, wherein like reference numerals represent like parts throughout the views, embodiments of the present invention will be described in detail.

Figure 1B:
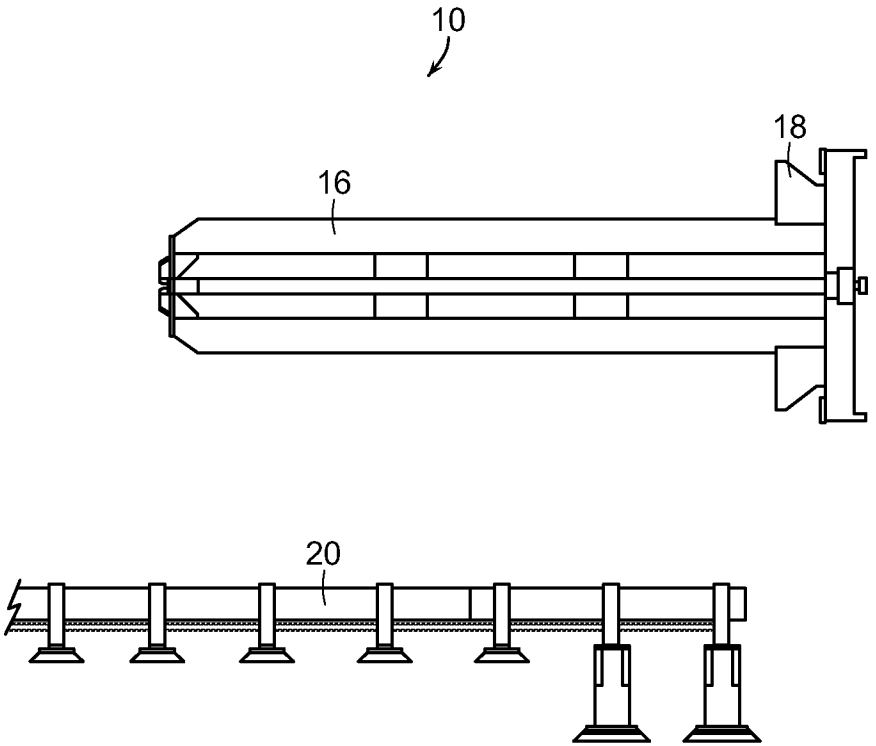

With reference initially to FIG. 1, an exemplary embodiment of a system in accordance with the present invention is shown at 10. The system is designed to transfer a cylindrical coil "C" suspended on a first stem 12 projecting horizontally from a first base 14 to a remotely positioned (FIG. 1A) and axially aligned second stem 16 projecting horizontally from a second base 18 (FIG. 1B). The coil C had originally been formed about stem 14 when it was vertically oriented as indicated by the broken lines at 14 (FIG. 1A).

The system comprises a track 20 extending between the first and second stems 12, 16. A carriage 22 is movable in opposite directions along the track 20. A conveyor 24 is supported on the carriage. The conveyor 24 has a receiving end 24*a* and a delivery end 24*b*.

Figure 3:
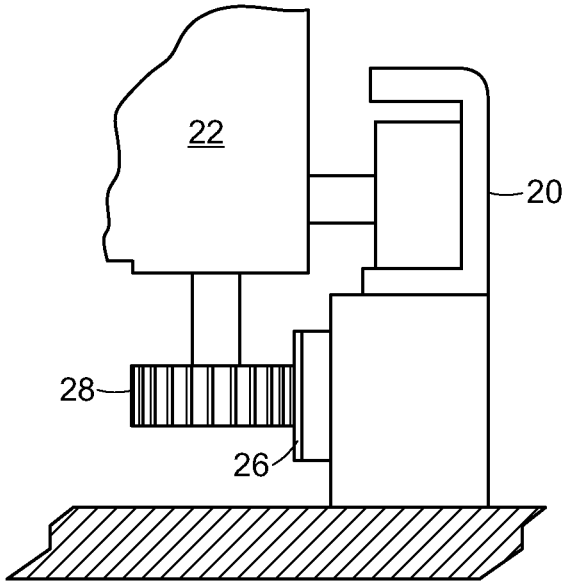
FIG. 3 is a partial cross sectional view of the carriage depicting an exemplary embodiment of the first operating means.

With reference additionally to FIG. 3, the carriage 22 can be moved in opposite directions along track 20 by a first operating means comprising a toothed rack 26 extending along the length of the track 20. The track 26 is engaged by a sprocket 28 rotatably driven by a conventional power train (not shown) carried by the carriage. Optionally, the first operating means may comprise other functionally equivalent systems for propelling carriage 22 in opposite directions along track 26, one example being a cable and pulley system.

The conveyor 24 is vertically adjustable by a second operating means comprising an underlying linkage system 32.

Figure 2:
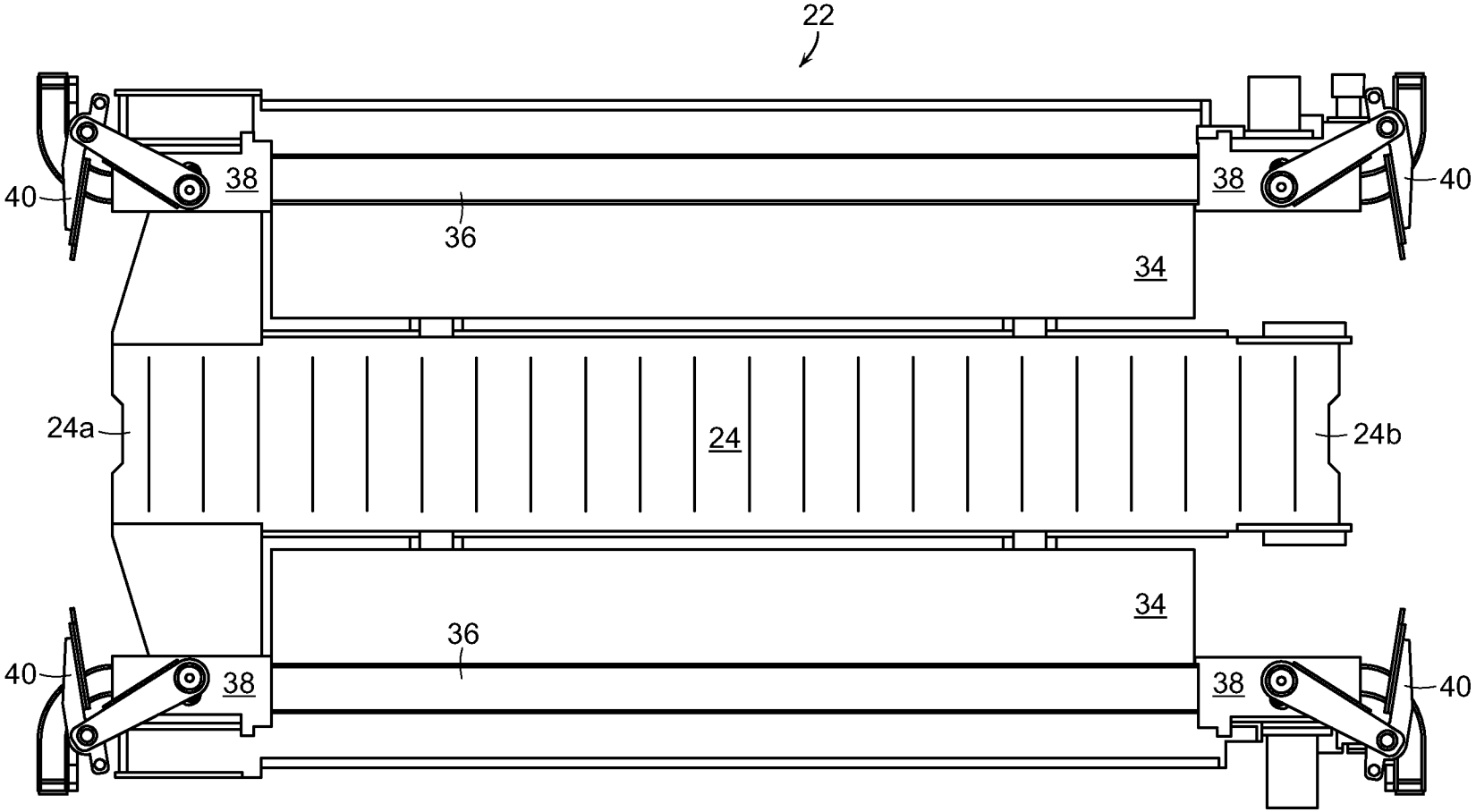
FIG. 2 is a plan view of a carriage depicted in FIG. 1, in accordance with an exemplary embodiment of the present invention.

As can be best seen in FIG. 2, the carriage 22 is equipped with containment means comprising laterally extending outriggers 34 having tracks 36 along which mini carriages 38 are movably mounted. Pivotally adjustable finger elements 40 are carried by the mini carriages.

As depicted in FIGS. 1 and 2, the carriage 22 is located midway between the first and second stems 12, 16. Although not shown, it will be understood that at this stage, mill personnel will have already trimmed and removed scrap rings from the exposed top end of the coil.

Figure 4:
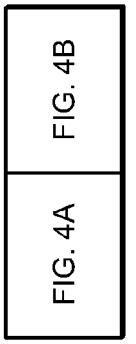
FIGS. 4-6 are views similar to FIG. 1 showing successive stages in the transfer of a coil from the first stem to the second stem.
Figure 4A:
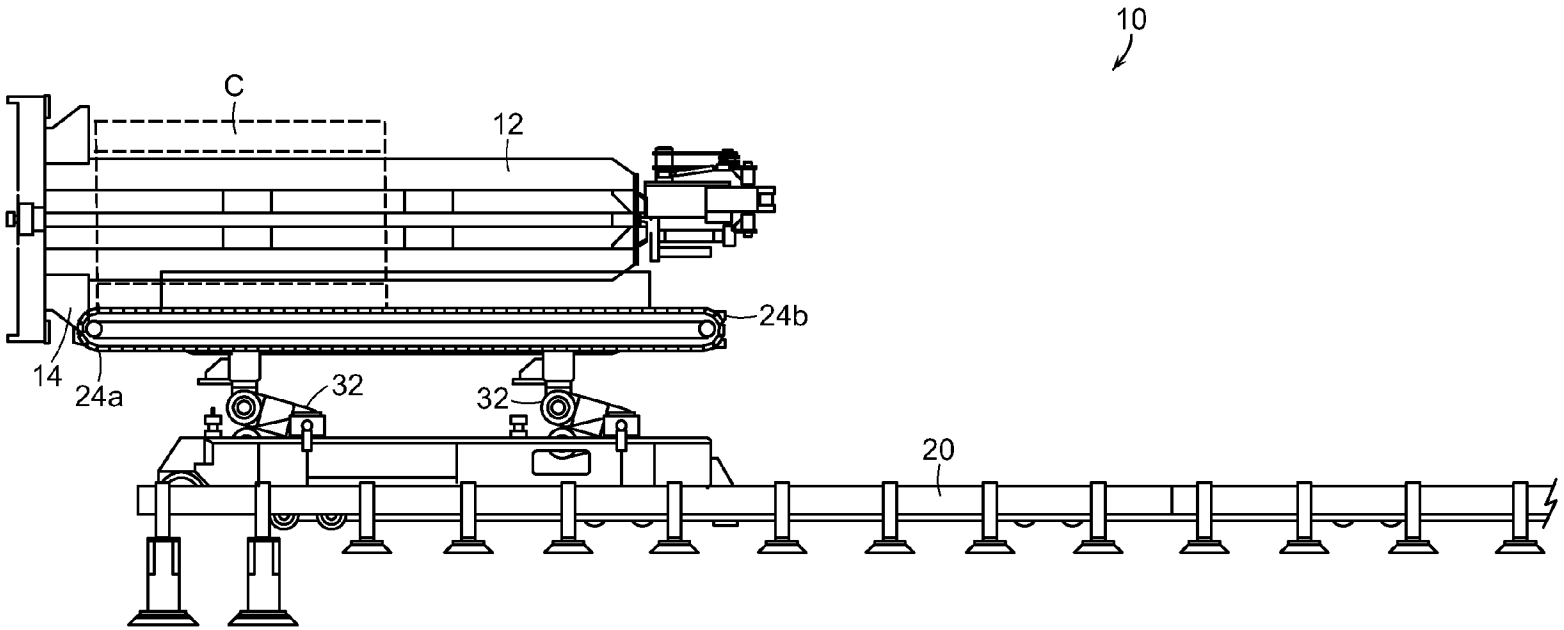
Figure 4B:
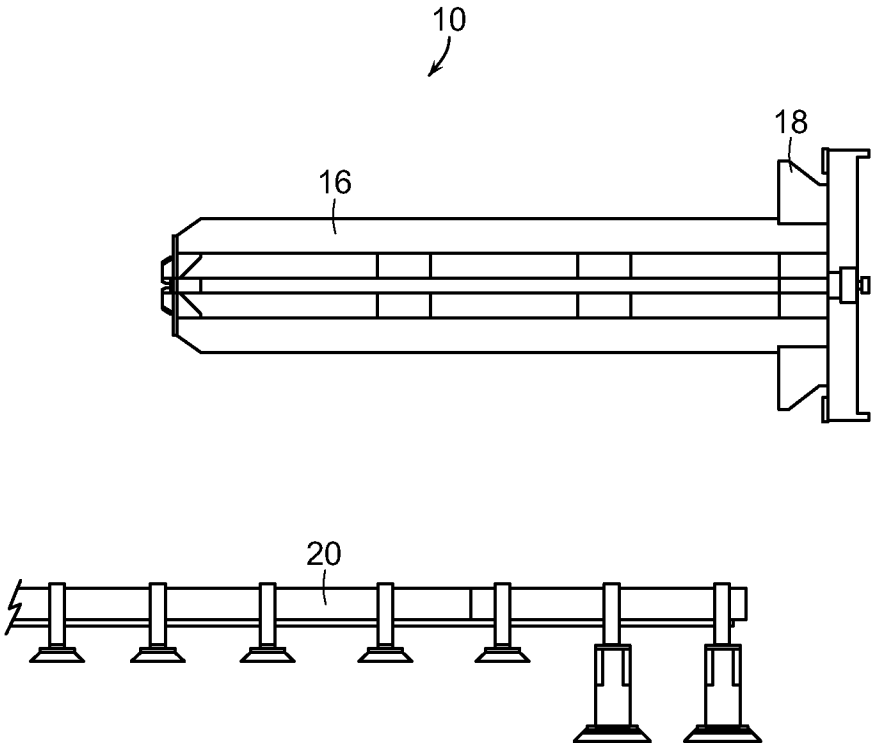
Figure 7:
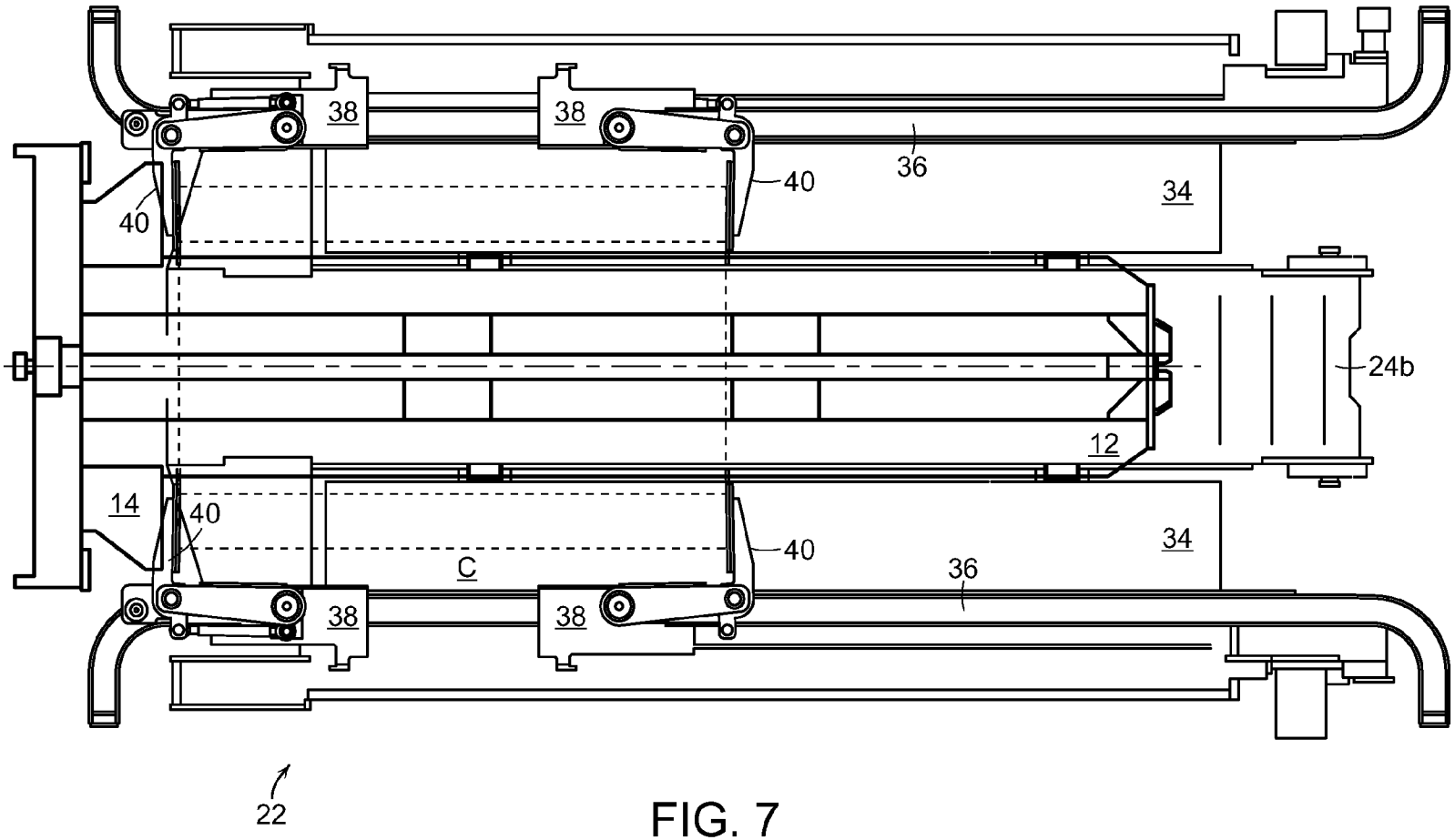
FIGS. 7-9 are views similar to FIG. 2, again showing successive stages in the transfer of a coil from the first stem to the second stem.
Figure 11:
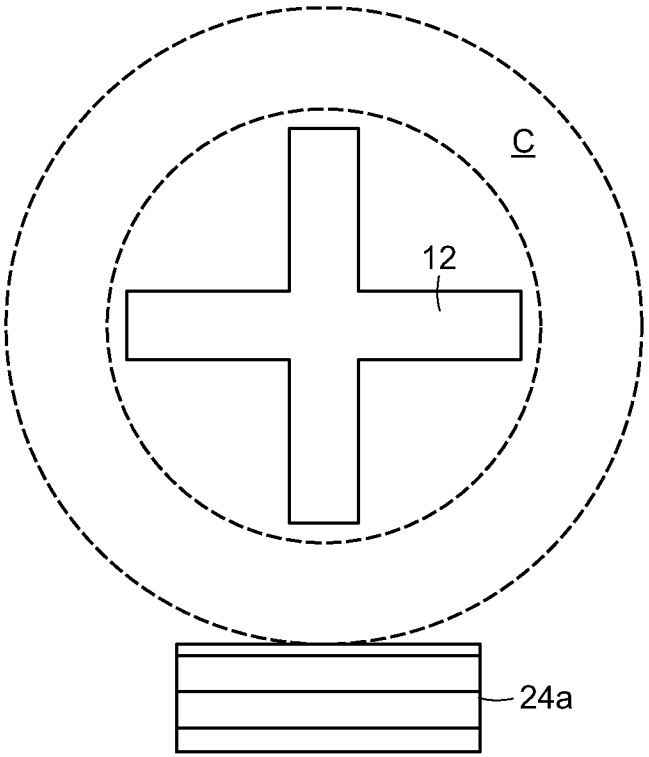
FIG. 11 is a diagrammatic illustration similar to FIG. 10 showing the coil lifted from the stem and supported on the receiving end of the conveyor.
Figure 10:
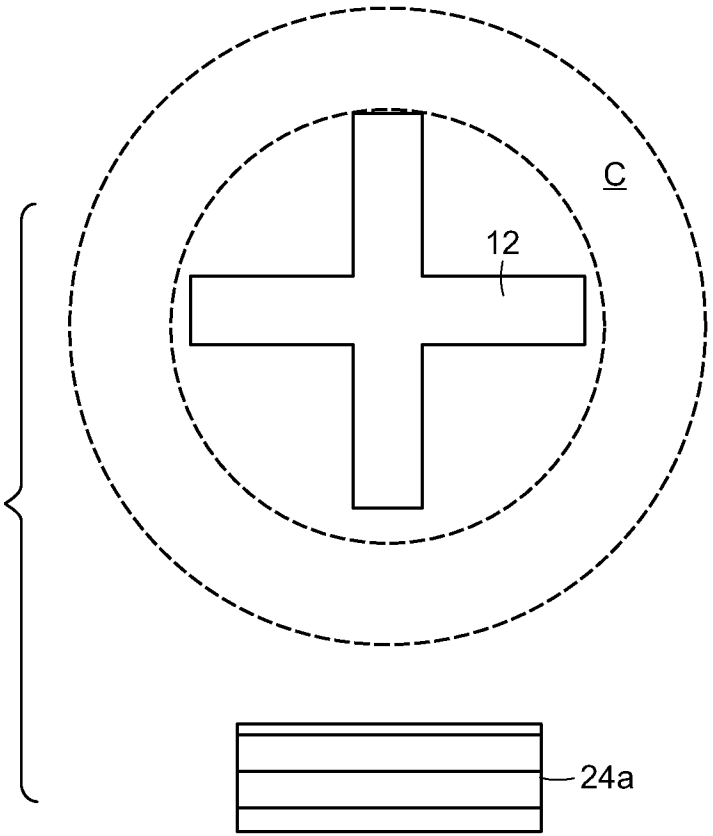
FIG. 10 is a diagrammatic illustration showing the receiving end of the conveyor spaced beneath a coil supported on a stem.

In a typical coil transfer sequence, the carriage 22 is shifted by the first operating means along track 20 to a first location as depicted in FIG. 4. At this location, as shown in FIG. 10, the receiving end 24*a* of conveyor 24 underlies and is spaced beneath the coil C suspended from stem 12. As shown in FIG. 11, the conveyor can be raised by the second operating means to lift the coil off the stem 12. With the coil now carried on the conveyor 24, and as shown in FIG. 7, the finger elements 40 are adjusted to operatively engage the opposite ends of the coil, thus axially confining the coil to thereby prevent endmost rings from falling over.

The carriage 22 moves along track 20 away from stem 12 and towards stem 16, resulting in the coil being axially removed from stem 12. Coil removal is accomplished without sliding contact of the coil interior with stem 12, thus avoiding any scratching of interior rings.

Figure 5:
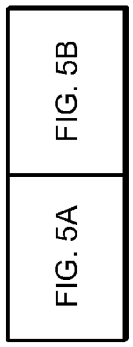
Figure 5A:
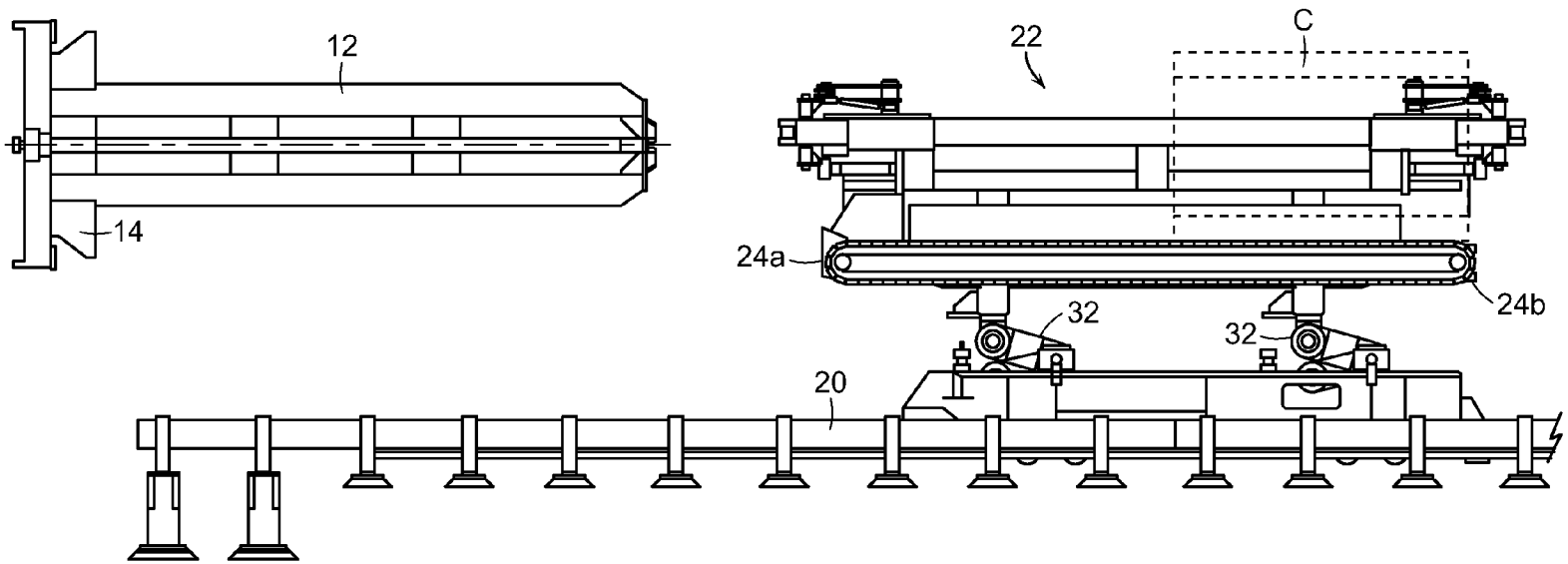
Figure 5B:
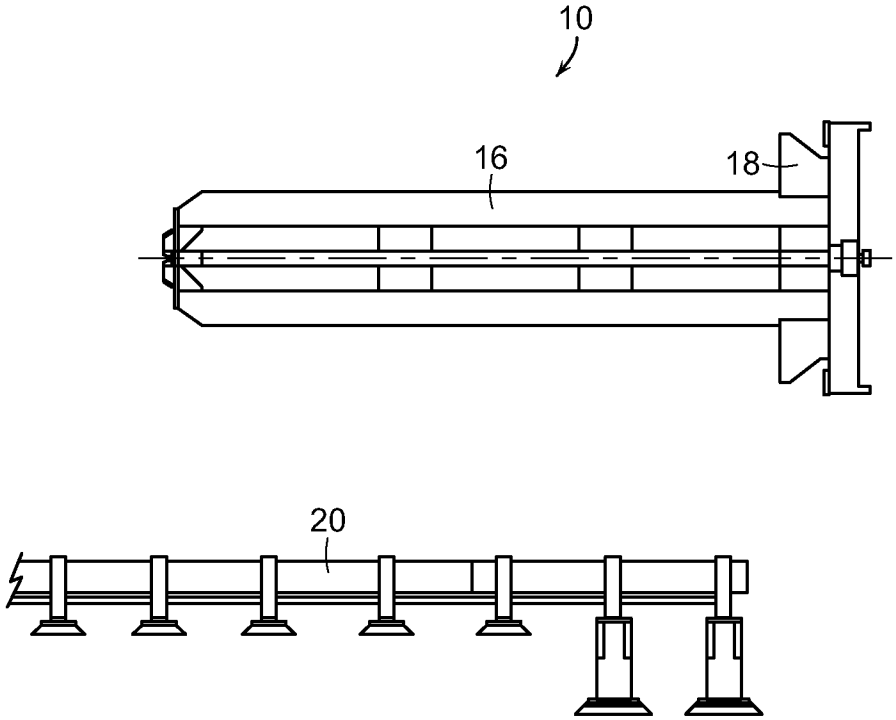
Figure 8:
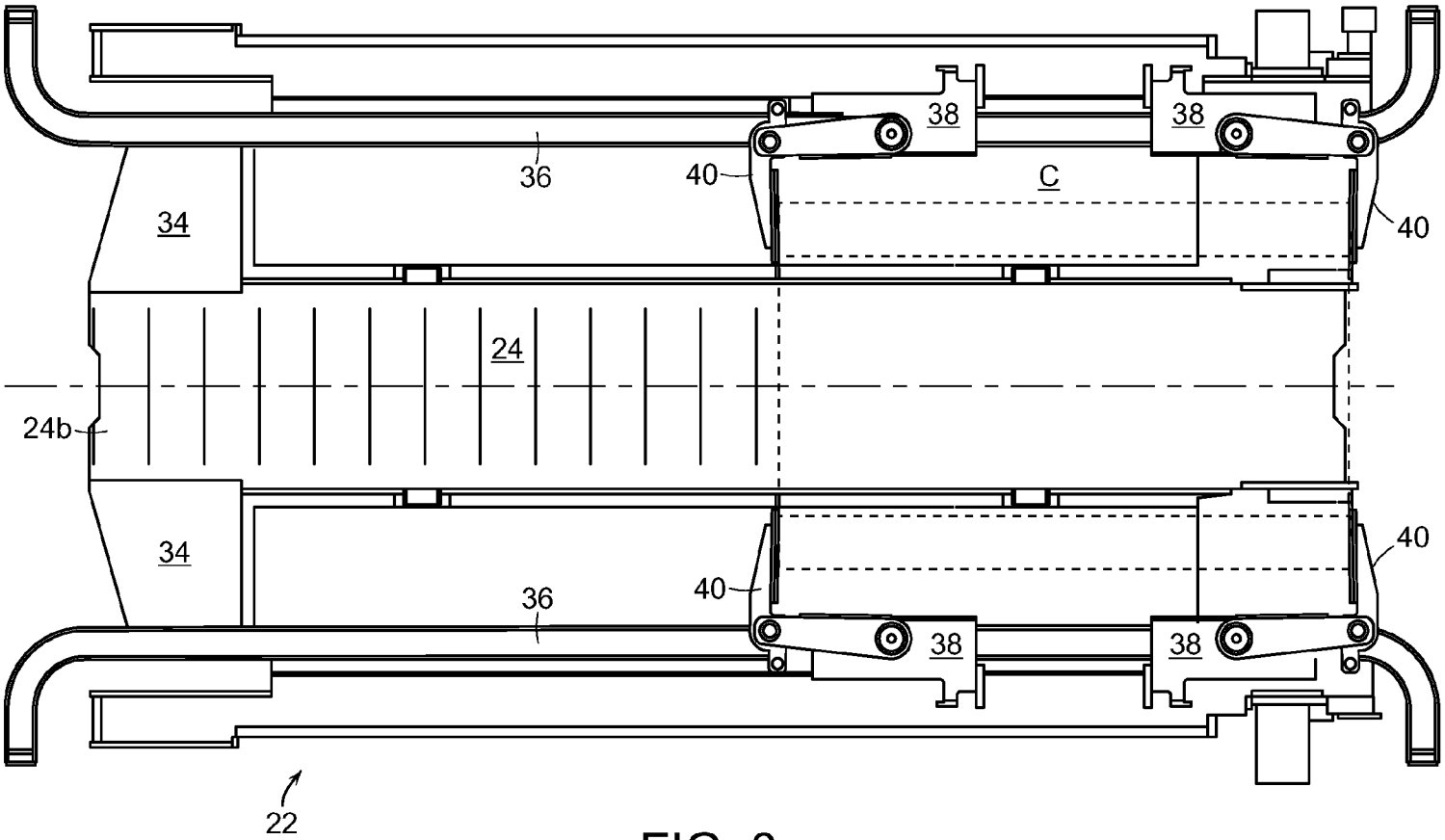

As shown in FIGS. 5 and 8, at some stage during the transfer of the coil towards stem 16, the conveyor 24 can shift the coil to a second intermediate position supported on conveyor delivery end 24*b*. Coil shifting along the conveyor is accompanied by the movement of the operatively engaged finger elements 40 in the same direction.

Figure 6:
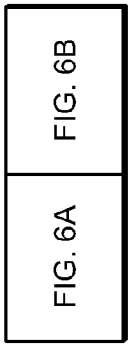
Figure 6A:
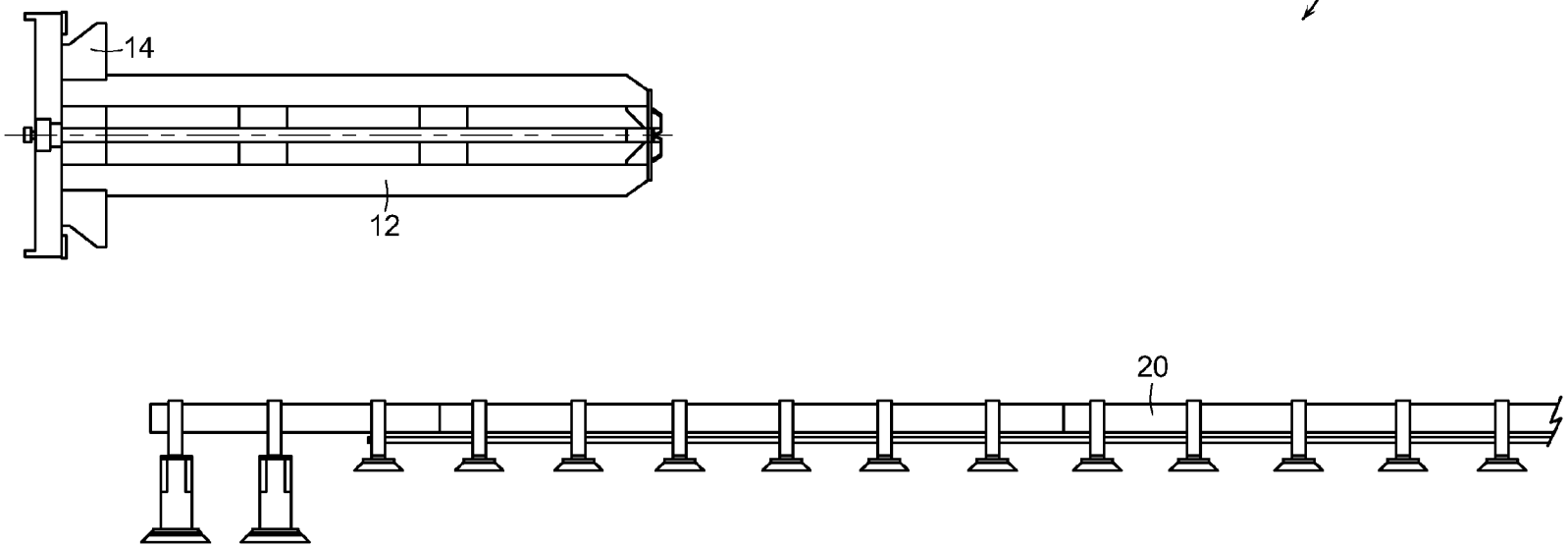
Figure 6B:
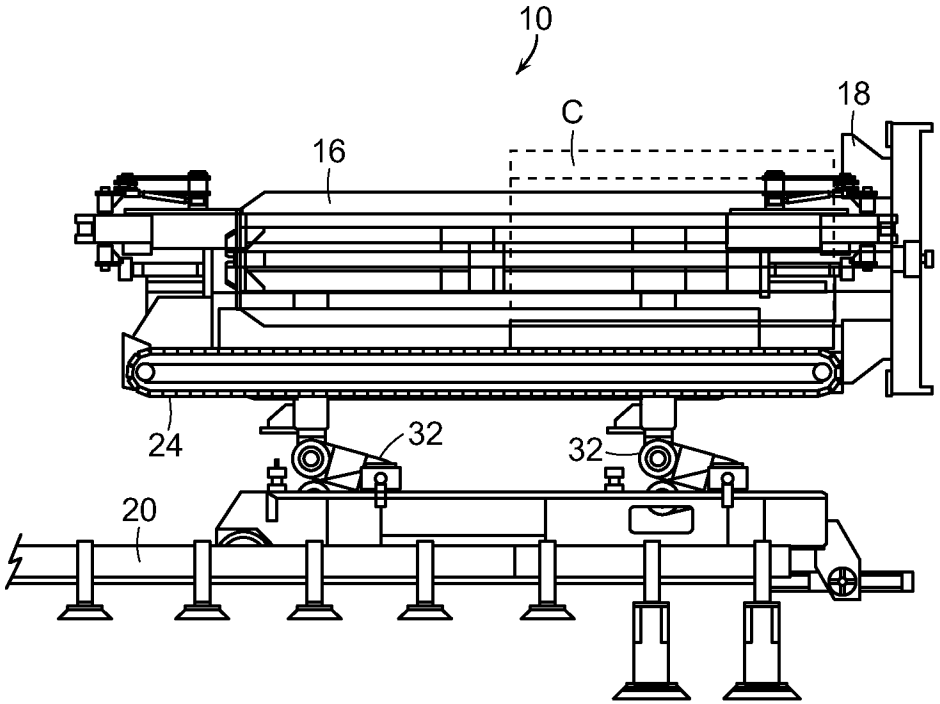
Figure 9:
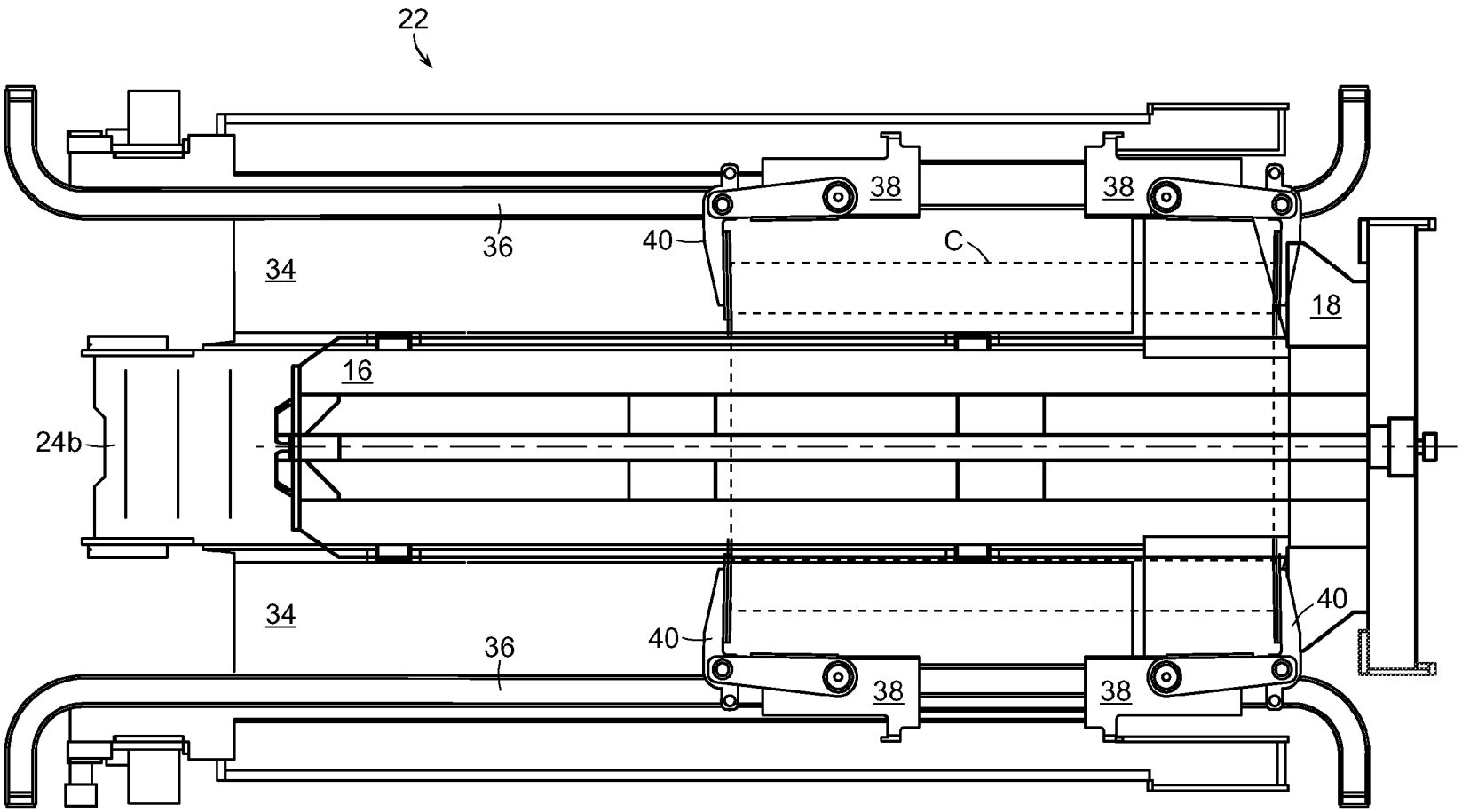

FIGS. 6 and 9 show the carriage 22 moved to a second location at which the coil is axially inserted on stem 16, with the previously trimmed top end of the coil directly adjacent to and preferably in contact with the second base 18. As with the previously described removal of the coil from stem 12, insertion of the coil on stem 16 is achieved while the coil remains supported on the conveyor 24, thus avoiding frictional contact of the coil interior with stem 16.

The conveyor 24 is then lowered to deposit the coil on stem 16, the finger elements 40 are disengaged from the opposite ends of the coil, and the carriage 22 is moved along track 20 away from stem 16 and towards stem 12 in preparation for the next coil handling cycle. At this stage, the bottom end of the coil is accessible for trimming by mill personnel.

In light of the foregoing, it will now be appreciated by those skilled in the art that use of the system of the present invention gives rise to several important advantages. Most importantly, coil transfer from one stem to the other is accomplished without potentially damaging sliding contact between the stems and the coil interiors. In addition, the coils are axially confined during transfer between the stems, thus insuring that coil integrity is maintained.

What is claimed is:

1. A system for transferring a cylindrical coil from a first location to a remote second location, said system comprising:

a first stem on which said coil is suspended, said first stem projecting horizontally from a first base at said first location;

a second stem projecting horizontally from a second base at said second location, said second stem being aligned axially with said first stem;

a track extending between said first and second stems;

a carriage movable along said track;

a conveyor on said carriage, said conveyor having a receiving end and a delivery end;

a first operating means for moving said carriage along said track to said first location and into a position at which the receiving end of said conveyor underlies the coil suspended from said first stem;

a second operating means for vertically adjusting said conveyor from a lowered position spaced beneath the coil suspended from said first stem to an elevated position at which the coil is lifted from said first stem and supported on the receiving end of said conveyor, said conveyor being operable to shift the coil to a position supported on the delivery end of said conveyor;

said first operating means being operable to move said carriage from said first location to said second location and into a position at which said coil is axially inserted on the horizontally positioned second stem, with an end of the coil in contact with said second base, said second operating means being then operable to return said conveyor to its lowered position, resulting in the coil being lowered and suspended on the horizontally positioned second stem, thereby allowing said carriage to be returned by said first operating means to said first location.

2. The system of claim 1 further comprising containment means for axially confining said coil during its movement from said first stem to said second stem.

3. The system of claim 2 wherein said containment means comprises finger elements operatively engageable with opposite ends of said coil.

4. The system of claim 1 wherein said first operating means comprises a toothed rack extending along the length of said track, said rack being engaged by a driven sprocket carried by said carriage.

5. The system of claim 1 wherein said second operating means comprises linkage means on said carriage.

6. A system for transferring a cylindrical coil suspended on a first stem projecting horizontally from a first base to a remotely positioned and axially aligned second stem projecting horizontally from a second base, said system comprising:

a track extending between said first and second stems;

a carriage movable along said track;

a conveyor on said carriage, said conveyor having a receiving end and a delivery end;

a first operating means for moving said carriage along said track to a first location at which the receiving end of said conveyor underlies the coil suspended from said first stem;

a second operating means for vertically adjusting said conveyor from a lowered position spaced beneath the coil suspended from said first stem to an elevated position at which the coil is lifted from said first stem and supported on the receiving end of said conveyor, said conveyor being operable to shift the coil to a position supported on the delivery end of said conveyor;

said first operating means being operable to move said carriage from said first location to a second location at which said coil is axially inserted on the horizontally positioned second stem and with an end of the coil in contact with said second base, said second operating means being then operable to return said conveyor to its lowered position, resulting in the coil being lowered to a position suspended on the horizontally positioned second stem, thereby allowing said carriage to be returned by said first operating means to said first location; and containment means comprising finger elements operatively engageable with opposite ends of said coil for axially confining said coil during its movement from said first stem to said second stem, said operatively engaged finger elements being movable with said coil as said coil is shifted along said conveyor.

7. A system for transferring a cylindrical coil suspended on a first stem projecting horizontally from a first base to a remotely positioned and axially aligned second stem projecting horizontally from a second base, said system comprising:

a track extending between said first and second stems;

a carriage movable along said track; a conveyor on said carriage, said conveyor having a receiving end and a delivery end;

a first operating means for moving said carriage along said track to a first location at which the receiving end of said conveyor underlies the coil suspended from said first stem, said first operating means comprising a toothed rack extending along the length of said track, said rack being engaged by a driven sprocket carried by said carriage;

a second operating means for vertically adjusting said conveyor from a lowered position spaced beneath the coil suspended from said first stem to an elevated position at which the coil is lifted from said first stem and supported on the receiving end of said conveyor, said second operating means comprising linkage means on said carriage, said conveyor being operable to shift the coil to a position supported on the delivery end of said conveyor;

said first operating means being operable to move said carriage from said first location to a second location at which said coil is axially inserted on the horizontally positioned second stem and with an end of the coil in contact with said second base, said second operating means being then operable to return said conveyor to its lowered position, resulting in the coil being lowered to a position suspended on the horizontally positioned second stem, thereby allowing said carriage to be returned by said first operating means to said first location; and containment means for axially confining said coil during its movement from said first stem to said second stem.

8. A system for transferring a cylindrical coil suspended on a first stem projecting horizontally from a first base to a remotely positioned and axially aligned second stem projecting horizontally from a second base, said system comprising:

a track extending between said first and second stems; a carriage movable along said track;

a conveyor on said carriage, said conveyor having a receiving end and a delivery end;

a first operating means for moving said carriage along said track to a first location at which the receiving end of said conveyor underlies the coil suspended from said first stem, said first operating means comprising a toothed rack extending along the length of said track, said rack being engaged by a driven sprocket carried by said carriage;

a second operating means for vertically adjusting said conveyor from a lowered position spaced beneath the coil suspended from said first stem to an elevated position at which the coil is lifted from said first stem and supported on the receiving end of said conveyor, said conveyor being operable to shift the coil to a position supported on the delivery end of said conveyor;

said first operating means being operable to move said carriage from said first location to a second location at which said coil is axially inserted on the horizontally positioned second stem and with an end of the coil in contact with said second base;

containment means for axially confining said coil during movement of said coil from said first stem to said second stem;

said second operating means being then operable to return said conveyor to its lowered position, resulting in the coil being lowered to a position suspended on the horizontally positioned second stem, thereby allowing said carriage to be returned by said first operating means to said first location.

* * * * *